US006087994A

United States Patent [19]

Lechter

[11] Patent Number: 6,087,994

[45] Date of Patent: Jul. 11, 2000

[54] RETRACTABLE ANTENNA FOR A CELLULAR PHONE

[76] Inventor: Robert Lechter, 3725 N. 37th Ter., Hollywood, Fla. 33021

[21] Appl. No.: 09/233,648

[22] Filed: Jan. 19, 1999

[51] Int. Cl.[7] ..... H01Q 1/24

[52] U.S. Cl. ..... 343/702; 343/901

[58] Field of Search ..... 343/702, 901, 343/903, 895; H01Q 1/24

[56] References Cited

U.S. PATENT DOCUMENTS

| | | | |
|---|---|---|---|
| 5,177,492 | 1/1993 | Tomura et al. | 343/702 |
| 5,204,687 | 4/1993 | Elliott et al. | 343/702 |
| 5,374,937 | 12/1994 | Tsunekawa et al. | 343/702 |
| 5,504,494 | 4/1996 | Chatzipetros et al. | 343/702 |
| 5,507,012 | 4/1996 | Luxon et al. | 455/89 |
| 5,541,609 | 7/1996 | Stutzman et al. | 343/901 |
| 5,548,827 | 8/1996 | Hanawa et al. | 455/129 |
| 5,572,224 | 11/1996 | Moller et al. | 343/702 |
| 5,577,269 | 11/1996 | Ludewig | 455/90 |
| 5,577,586 | 11/1996 | Buckendahl | 192/45.1 |
| 5,594,459 | 1/1997 | Hirota | 343/749 |
| 5,606,327 | 2/1997 | Elliottt et al. | 343/702 |
| 5,617,105 | 4/1997 | Tsunekawa et al. | 343/702 |
| 5,635,943 | 6/1997 | Grunwell | 343/702 |
| 5,644,320 | 7/1997 | Rossi | 343/901 |
| 5,650,789 | 7/1997 | Elliott et al. | 343/702 |
| 5,650,790 | 7/1997 | Fukuchi et al. | 343/702 |
| 5,666,125 | 9/1997 | Luxon et al. | 343/702 |
| 5,691,730 | 11/1997 | Egashira et al. | 343/702 |
| 5,734,351 | 3/1998 | Ojantakanen et al. | 343/702 |

*Primary Examiner*—Michael C. Wimer
*Attorney, Agent, or Firm*—Quarles & Brady LLP

[57] ABSTRACT

An antenna assembly for a cellular telephone reduces electrical signal interference caused by the close proximity of the antenna to the user's head. The antenna assembly includes a coil antenna mounted on the top of a telescoping rod member. Only the coil antenna is adapted for transmitting and receiving electrical signals. The coil antenna is electrically connected, via a coaxial cable, to a telephone transceiver circuit board. In operation, the telescoping rod member is extended until the coil antenna is positioned at a height above the user's head to minimize the transmission of electrical signals toward the user's head.

3 Claims, 3 Drawing Sheets

RETRACTABLE ANTENNA FOR A CELLULAR PHONE

FIELD OF THE INVENTION

This invention relates generally to retractable antenna systems for electrical devices, and more particularly to a retractable antenna for a cellular telephone.

BACKGROUND OF THE INVENTION

Various types of antennas are known for use with modern electronic transceiver devices, such as cellular telephones. Generally, antennas either have a fixed length or are retractable from an extended position. Retractable antennas are generally preferred because they enable the user to retract most of the length of the antenna into the device housing, thereby improving device portability. Conventionally, antennas for cellular transceivers comprise a helical coil antenna mounted atop a rod antenna. Both the rod antenna and coil antenna are adapted for transmitting and receiving electrical signals. In operation, at least a portion of the antenna is positioned adjacent to the side of the head of the device operator. In some instances, the operator's head may obstruct the transmission and/or receipt of electrical signals to and from the antenna. As a consequence, electrical signals transmitted from and/or received by the cellular device may be distorted. A further consequence of the positioning of the antenna is the growing concern in the medical community—and among the general population 13 that the proximity of the antenna to the user's head may cause health problems. Regardless of whether or not such concerns are warranted, the mere perception of a potential health risk is sufficient to negatively impact the sale of such devices.

For these and other reasons, there is a well-established need for an antenna for a cellular transceiver which is useful for transmitting and receiving electrical signals while minimizing, or eliminating, the aforementioned consequences of known antenna designs.

SUMMARY OF THE INVENTION

It is an object of this invention to provide an antenna assembly capable of transmitting and receiving electrical signals while reducing signal distortion caused by the proximity of the antenna to the device operator's head.

It is another object of this invention to provide an antenna assembly for reducing potential health risks resulting from the transmission of electronic signals toward the device operator's head.

It is another object of this invention to provide an antenna assembly which can be easily adapted for use with existing portable cellular telephones.

These and other objects are achieved with the antenna assembly of the present invention. Briefly, according to the invention, an antenna assembly includes a coil antenna attached at the distal end of a retractable rod member. In the preferred embodiment of the invention, the rod member has a telescoping structure. The coil antenna is adapted for transmitting and receiving electrical signals. The rod member is not adapted for transmitting or receiving electrical signals. A coaxial cable extending axially through the rod member is electrically connected at a first end to the coil antenna and at a second end to a transceiver circuit board contained within the device housing.

In an alternate embodiment of the invention, the antenna assembly includes an antenna housing adapted for attachment to a rear surface of the transceiver device. The antenna housing has a first aperture through which the retractable rod member is disposed. In this embodiment, the second end of the coaxial cable extends through a second antenna housing aperture and is adapted for releasable connection to an external antenna jack on the transceiver device. As the rod member is retracted into the antenna housing, excess coaxial cable extending from the near end of the rod member is contained within the antenna housing.

In both embodiments, the antenna can be operated in both extended and retracted positions. When the rod member is fully extended during use, the coil antenna is positioned at a level above the user's head. During operation, signals are transmitted and received solely through the coil antenna member. Consequently, when the rod member is fully extended, signals transmitted and received by the device are not obstructed by the user's head, and such signals should not be expected or perceived to pose adverse health effects.

DETAILED DESCRIPTION OF THE PREFERRED EMBODIMENTS

Figure 1:
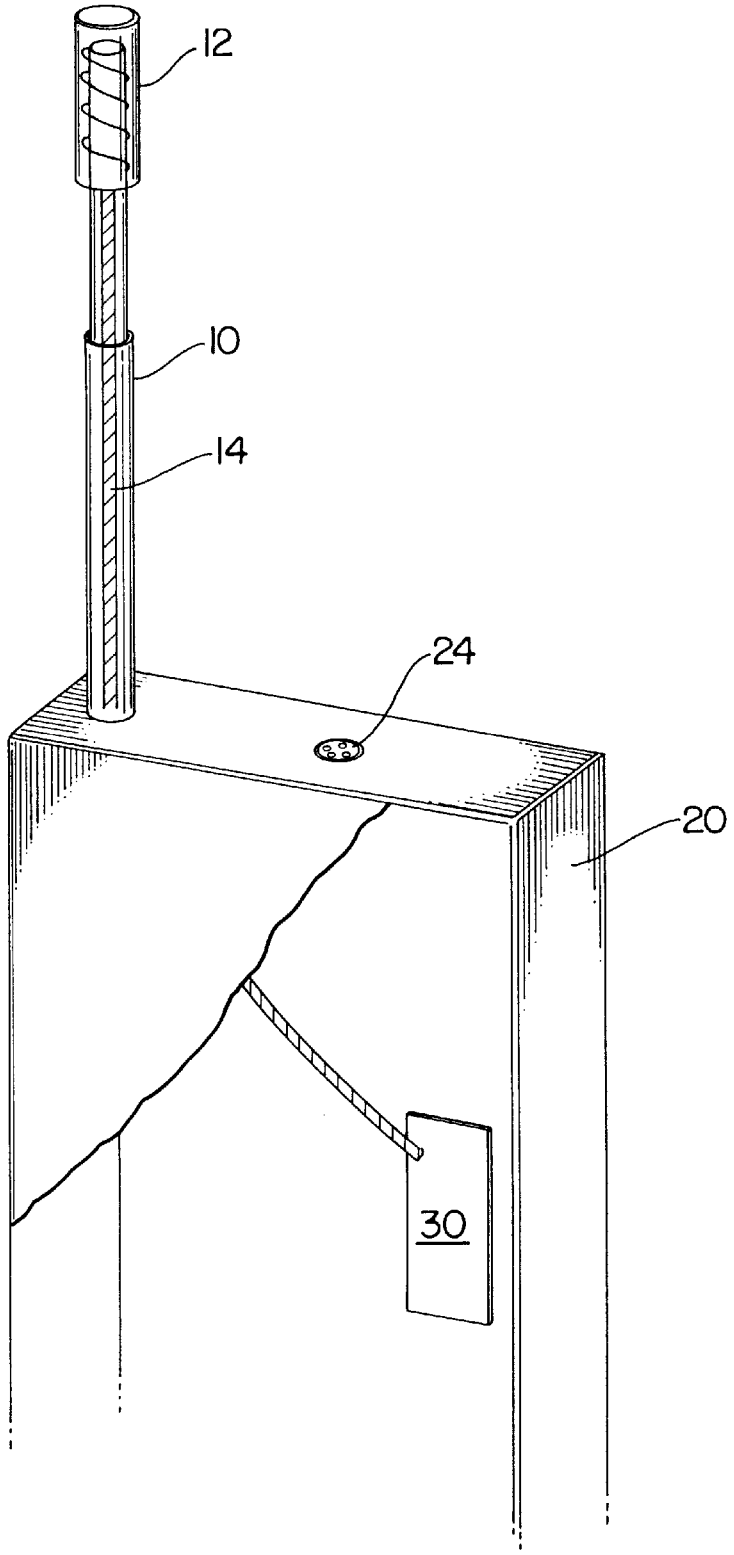
FIG. 1 is a perspective view of an antenna assembly in accordance with a preferred embodiment of the present invention.

Referring now to FIG. 1, an antenna assembly is illustrated in accordance with a preferred embodiment of the present invention. The antenna assembly is designed for use with a transceiver device 20, such as a portable cellular telephone. The antenna assembly includes a retractable rod member 10 which extends through an upper surface of the transceiver device 20. In the preferred embodiment of the invention, the antenna has a telescoping structure which enables the rod member to be extended and retracted. A coil antenna member 12 is mounted on the distal end of the telescopic rod member 10. Coil antennas (also referred to as "helical" or "stub" antennas) are well known in the art. In contrast to conventional antenna structures, the retractable rod portion 10 of the antenna assembly of the present invention is not adapted for transmitting or receiving electrical signals. Consequently, all electrical signals transmitted from, and received by, the device are directed only through the coil antenna member 12. A coaxial cable 14 attached at a first end to coil antenna member 12, and at a second end to a transceiver circuit board 30 inside of the device housing, restricts signal transmission and reception to the coil antenna member.

Figure 2:
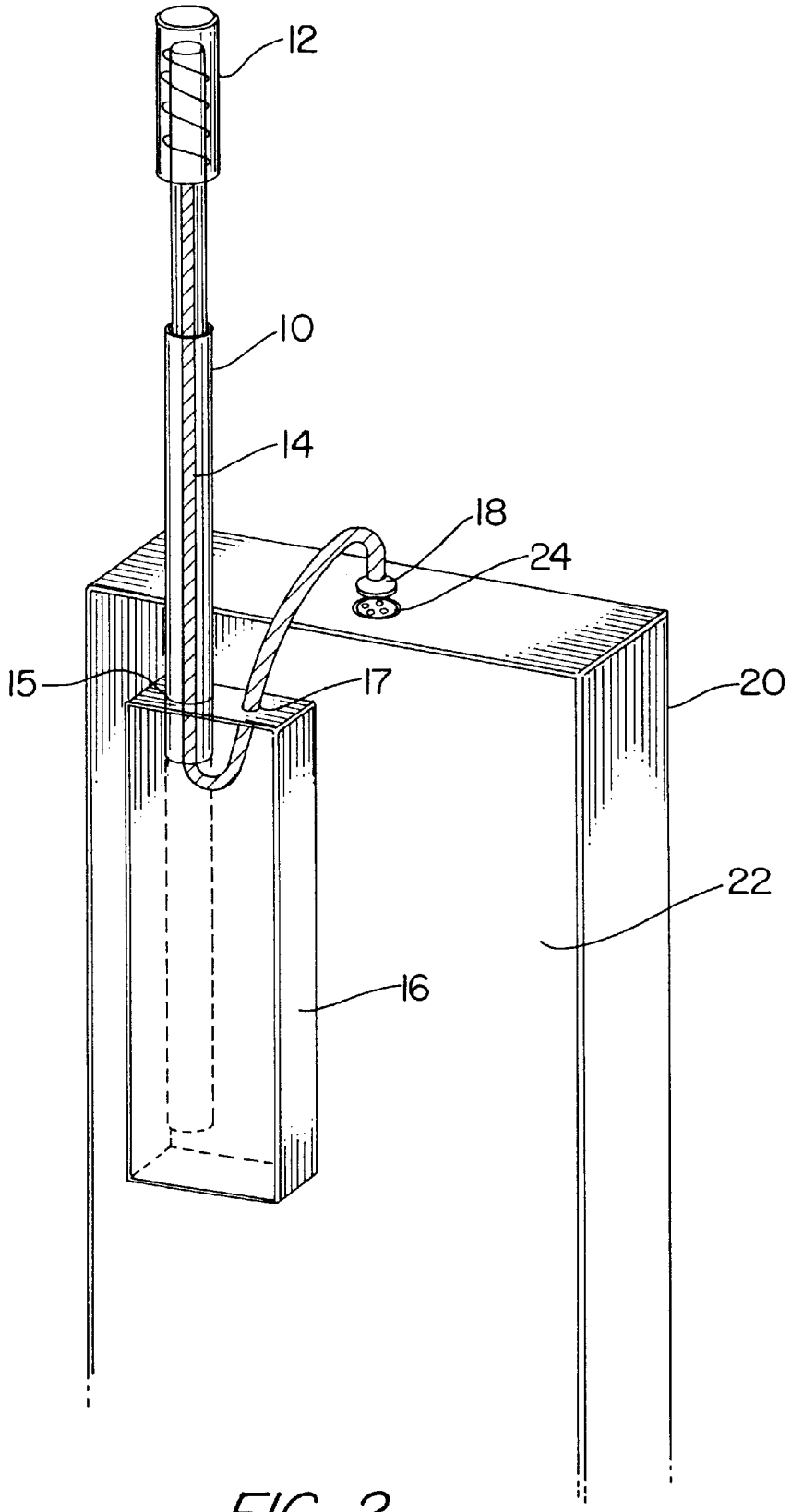
FIG. 2 is a perspective view of an antenna assembly in a fully-extended position, in accordance with an alternate embodiment of the present invention.
Figure 3:
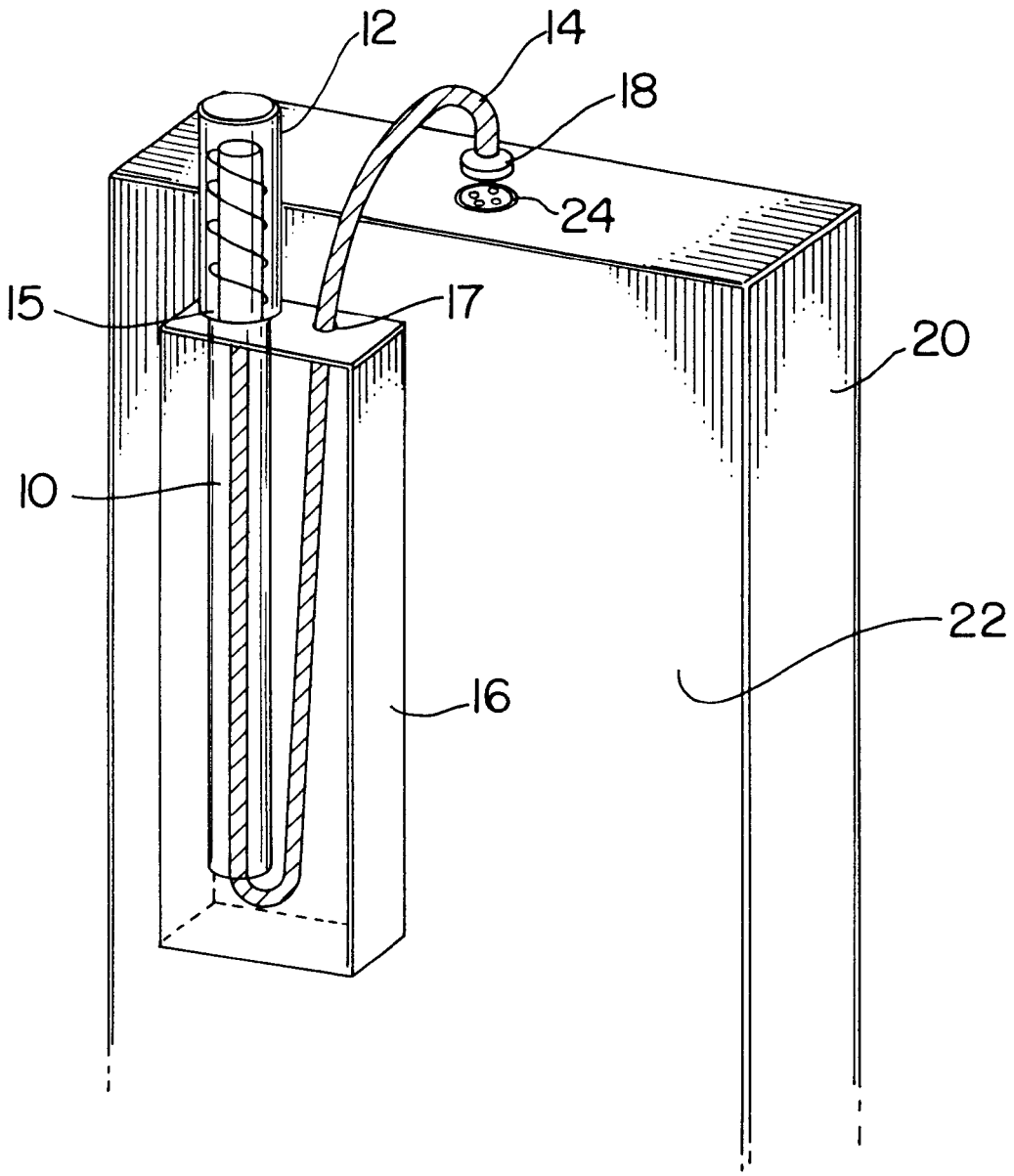
FIG. 3 is a perspective view of an antenna assembly in a fully-retracted position, in accordance with an alternate embodiment of the present invention.

Referring now to FIGS. 2 and 3, in an alternate embodiment of the present invention, the antenna assembly includes an antenna housing 16 adapted for attachment to the rear housing surface 22 of a conventional cellular telephone. Preferably, antenna housing 16 is fixedly attached to the device housing with a curable adhesive. However, other well known methods of attachment are possible (e.g., mechanical fasteners, snap-fit construction, etc.) without departing from the scope of the invention. A retractable rod member 10 extends through a first aperture 15 in the upper surface of the antenna housing. Rod member 10 is not adapted for transmitting or receiving electrical signals. Coaxial cable 14 is provided for transmitting signals between coil antenna 12 and a transceiver circuit board (not shown in FIGS. 2 and 3) inside of the telephone housing. The coaxial cable 14 is attached at a first end to coil antenna member 12. A second end 18 of the coaxial cable is adapted for being plugged into an external antenna jack 24 standard on most cellular telephones. The coaxial cable extends from the coil antenna member 12, axially along the length of rod member 10, into antenna housing 16. A relatively short length of the coaxial cable, proximate to end 18, extends through and remains exposed through a second aperture 17 in antenna housing 16. Referring now to FIG. 3, when rod member 10 is in a fully-retracted position, an excess length of the coaxial cable, previously contained withing rod member 10, is contained by antenna housing 16.

In the preferred and alternate embodiments of the present invention, electrical signals can be transmitted and received by the transceiver device regardless of the antenna position (i.e., extended or retracted). In particular, electrical signals are transmitted/received only through coil antenna member 12. In operation, the antenna is maintained in a fully-retracted position while the device is in a stand-by mode. Generally, in this mode the device is positioned away from the user's head. Upon receiving a call, or making a call, the user simply extends the retractable rod member 10 such that the device is operated with coil antenna 12 positioned at a height above the user's head. In this manner, electrical signals can be transmitted or received by the device with minimal signal distortion caused by the position of the user's head.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. An antenna assembly for an electronic transceiver device, said device having transceiver circuitry contained within a device housing, said antenna assembly comprising:

a coil antenna element adapted for transmitting and receiving electrical signals;

a retractable rod member exclusively adapted for supporting said coil antenna element mounted on the distal end of said retractable rod member;

a coaxial cable extending axially through said retractable rod member, said coaxial cable having a first end electrically connected to said coil antenna element and having a second end in electrical communication with said transceiver circuitry, said second end adapted for releasable connection to an external antenna jack of said device housing: and, an antenna housing adapted for attachment to an outer surface of said transceiver device, said antenna housing adapted for receiving said retractable rod member and an excess length of said coaxial cable when said rod member is retracted into said antenna housing, wherein upon fully extending said retractable rod member, said coil antenna element is positioned at a height above the head of an operator of said device, thereby minimizing electrical signal interference.

2. An antenna assembly as recited in claim 1, wherein said electronic transceiver device is a cellular telephone.

3. An antenna assembly as recited in claim 1, wherein said retractable rod member has a telescopic structure.

* * * * *